US005941697A

United States Patent [19]

Chaouki et al.

[11] Patent Number: 5,941,697

[45] Date of Patent: Aug. 24, 1999

[54] PROCESS AND APPARATUS FOR GAS PHASE EXOTHERMIC REACTIONS

[75] Inventors: Jamai Chaouki, Pointe-Claire; Hristo Sapoundjiev, Montreal; Christophe Guy, Montreal; Danilo Klvana, Montreal; Kebir Ratnani, Boucherville, all of Canada

[73] Assignees: La Corporation de L'Ecole Polytechnique Gaz Metropolitain; Company Limited Partnership, both of Montreal, Canada

[21] Appl. No.: 08/763,447

[22] Filed: Dec. 11, 1996

[51] Int. Cl.[6] ..... F23G 5/46; F23G 7/06

[52] U.S. Cl. ..... 431/7; 431/5; 431/11; 431/215

[58] Field of Search ..... 431/5, 7, 11, 215, 431/170; 423/245.3, 247; 432/180, 181, 182; 422/175, 182, 183

[56] References Cited

U.S. PATENT DOCUMENTS

| | | | |
|---|---|---|---|
| 2,946,651 | 7/1960 | Houdry . | |
| 3,870,474 | 3/1975 | Houston . | |
| 4,478,808 | 10/1984 | Matros et al. . | |
| 4,604,051 | 8/1986 | Davies et al. . | |
| 4,730,599 | 3/1988 | Kendall et al. . | |
| 4,850,862 | 7/1989 | Bjerklie . | |
| 4,870,947 | 10/1989 | Kawamoto . | |
| 5,024,817 | 6/1991 | Mattison | 422/111 |
| 5,044,939 | 9/1991 | Dehlsen . | |
| 5,101,741 | 4/1992 | Gross et al. | 422/175 |
| 5,134,945 | 8/1992 | Reimlinger et al. | 432/181 |
| 5,364,259 | 11/1994 | Matros et al. . | |
| 5,366,708 | 11/1994 | Matros et al. | 423/210 |
| 5,431,147 | 7/1995 | Tanaka et al. . | |
| 5,571,491 | 11/1996 | Thunstrom | 423/245.3 |
| 5,589,142 | 12/1996 | Gribbon | 422/171 |
| 5,624,653 | 4/1997 | Grozev et al. . | |

FOREIGN PATENT DOCUMENTS

| | | |
|---|---|---|
| 1154933 | 10/1983 | Canada . |
| 337143 | 10/1989 | European Pat. Off. . |
| 02005367 | 1/1990 | Japan . |
| WO 91/12878 | 9/1991 | WIPO . |
| WO 93/11857 | 6/1993 | WIPO . |

*Primary Examiner*—Carl D. Price
*Attorney, Agent, or Firm*—Foley & Lardner

[57] ABSTRACT

The gas phase exothermic reaction of a feed gas mixture is carried out by providing first and second chambers in fluid communication with one another and each containing a bed of solid heat exchange material and at least one bed of catalyst material, each chamber being selectively operable in cooling and heating modes. The feed gas mixture is introduced into a selected one of the chambers when the selected chamber is in the cooling mode and the other chamber is in the heating mode so that the feed gas mixture flowing through the selected chamber contacts the bed of heat exchange material before contacting the bed of catalyst material, the feed gas mixture being reacted in the catalyst bed to form a gaseous product. The gaseous product is conducted from the selected chamber to the other chamber so that the gaseous product flowing through the other chamber contacts the bed of catalyst material before contacting the bed of heat exchange material. The direction of gas flow through the chambers is periodically reversed so that the first and second chambers alternately operate in the cooling and heating modes, thereby forming between the first and second chambers a hot zone containing the gaseous products. A portion of the gaseous product is discharged from the hot zone so as to withdraw sufficient heat to maintain the reaction in the catalyst bed of the selected chamber at a temperature below a predetermined maximum temperature, while maintaining autothermicity.

25 Claims, 5 Drawing Sheets

PROCESS AND APPARATUS FOR GAS PHASE EXOTHERMIC REACTIONS

BACKGROUND OF THE INVENTION

The present invention relates to a process and apparatus for the gas phase exothermic reaction of a feed gas mixture. More particularly, the invention is directed to a process and apparatus for the catalytic combustion of combustible gases.

Natural gas and other combustible gases are generally combusted in flame at temperatures of 1300–1600° C. Under these conditions, the combustion always generates NO and $NO_2$ which have destructive effects in nature, such as greenhouse effect, reduction of the stratospheric ozone layer, acid rains, etc.

Another method for the combustion of natural gas and other combustible gases is the catalytic oxidation. Classical catalytic combustors operate at temperatures of 600–900° C. Methane, the main component of the natural gas, requires higher temperature for its combustion. The necessity to maintain a high temperature and the exothermic character of the reaction create problems when the process is carried out in a fixed bed reactor. The main problem is the formation of hot spots in the fixed bed, leading to thermal deactivation of the catalyst and the production of NO and $NO_2$. The other disadvantage of classical catalytic combustors is their high sensitivity to the composition and temperature of the feed gas mixture, which creates a problem in controlling the process.

Another method for the combustion of hydrocarbons and combustible gases is the catalytic oxidation in a reactor with periodic flow reversal, conducted in a composite fixed bed containing a layer of heat exchange material on either side of the active catalyst bed. The gas flowing through the composite bed is controlled by a set of valves operating in tandem. The heat exchange layers of the bed function as preheaters for the feed gases or coolers for the combustion products. This function alternates depending on flow direction. Prior to the start up, the catalyst bed is preheated to the operating temperature. Unsteady-state operation is then provided by periodically reversing the direction of gas flow. Several modifications of this method have been proposed in U.S. Pat. Nos. 2,946,651, 3,870,474 and 5,364,259 as well as in Canadian Patent No. 1,154,933 for carrying out various processes. In U.S. Pat. No. 5,364,259, for example, volatile organic compounds found in gaseous process emissions are treated by catalytic oxidation in a regenerative incinerator. The disadvantage of the process described in the latter patent is the formation of hot spots that occurs in the reactor and leads to difficulties in controlling the temperature in the catalyst bed when the concentration of the volatile organic compounds is higher than 10 $g/m^3$. This leads to a thermal destruction of the catalyst and production of $NO_x$.

SUMMARY OF THE INVENTION

It is therefore an object of the present invention to overcome the above drawbacks and to provide a process and apparatus for the gas phase exothermic reaction of a feed gas mixture in the presence of a catalyst, which enable the temperature of reaction to be controlled in a manner such as to prevent the formation of hot spots, the generation of $NO_x$ and the thermal deactivation of the catalyst.

According to one aspect of the invention, there is provided a process for the gas phase exothermic reaction of a feed gas mixture, comprising the steps of:

a) providing first and second chambers in fluid communication with one another and each containing a bed of solid heat exchange material and at least one bed of catalyst material, each chamber being selectively operable in cooling and heating modes;

b) introducing the feed gas mixture into a selected one of the first and second chambers when the selected chamber is in the cooling mode and the other chamber is in said heating mode;

c) flowing the feed gas mixture through the selected chamber so that the feed gas mixture contacts the bed of heat exchange material before contacting the bed of catalyst material, the feed gas mixture being reacted in the catalyst bed to form a gaseous product;

d) conducting the gaseous product from the selected chamber to the other chamber;

e) flowing the gaseous product through the other chamber so that the gaseous product contacts the bed of catalyst material before contacting the bed of heat exchange material;

f) periodically reversing the direction of gas flow through the chambers so that the first chamber and the second chamber alternately operate in the cooling and heating modes, thereby forming between the first and second chambers a hot zone containing the gaseous product; and g) discharging a portion of the gaseous product from the hot zone so as to withdraw sufficient heat to maintain the reaction in the catalyst bed of the selected chamber at a temperature below a predetermined maximum temperature, while maintaining autothermicity.

The present invention also provides, in another aspect thereof, an apparatus for carrying out a process as defined above. The apparatus according to the invention comprises at least one housing defining first and second chambers in fluid communication with one another and each containing a bed of solid heat exchange material and at least one bed of catalyst material, each chamber being selectively operable in cooling and heating modes; inlet means for introducing the feed gas mixture into a selected one of the first and second chambers when the selected chamber is in the cooling mode and the other chamber is in the heating mode so that the feed gas mixture flowing through the selected chamber contacts the bed of heat exchange material before contacting the bed of catalyst material, the feed gas mixture being reacted in the catalyst bed to form a gaseous product; and means for conducting the gaseous product from the selected chamber to the other chamber so that the gaseous product flowing through the other chamber contacts the bed of catalyst material before contacting the bed of heat exchange material. The apparatus of the invention further includes gas flow directing means for periodically reversing the direction of gas flow through the chambers so that the first chamber and second chamber alternately operate in the cooling and heating modes, thereby forming between the first and second chambers a hot zone containing the gaseous product; and outlet means in fluid communication with the hot zone for discharging a portion of the gaseous product from the hot zone so as to withdraw sufficient heat to maintain the reaction in the catalyst bed of the selected chamber at a temperature below a predetermined maximum temperature, while maintaining autothermicity.

According to a preferred embodiment of the invention, the first and second chambers each comprise a second bed of catalyst material with the second catalyst bed being disposed in spaced relation to the first catalyst bed and downstream thereof when the chambers are in the cooling mode. The feed gas mixture is divided into major and minor portions with the major portion being flowed through the heat exchange bed and first catalyst bed of the selected chamber and the minor portion being mixed with the gaseous product formed in the first catalyst bed and thereafter being flowed through the second catalyst bed of the selected chamber.

Preferably, the first catalyst bed comprises a catalyst material having a low catalytic activity and the second catalyst bed comprises a catalyst material having a high catalytic activity. For example, the catalyst material of low catalytic activity can provide a conversion of no more than about 65% and the catalyst material of high catalytic activity can provide a conversion of about 100%. The catalyst material of low catalytic activity preferably used is a porous catalyst material of monolithic form having a porosity ranging from about 0.6 to about 0.85. The catalyst material of high catalytic activity preferably used is a porous catalyst material having a porosity of about 0.4 to about 0.6.

The formation of hot spots in the catalyst beds of the first and second chambers is prevented by controlling the temperature of reaction in the catalyst beds below a predetermined maximum temperature. Temperature control is achieved in accordance with the invention by discharging a portion of the gaseous product from the hot zone which is defined between the first and second chambers so as to withdraw sufficient heat to maintain the temperature of reaction below the predetermined maximum temperature, while maintaining autothermicity of the process. In a preferred embodiment of the invention, the temperature of reaction is additionally controlled by disposing the aforesaid two catalyst beds in each chamber and dividing the feed gas mixture into major and minor portions with the major portion being flowed through the heat exchange bed and first catalyst bed of the selected chamber and the minor portion being mixed with the gaseous product formed in the first catalyst bed and thereafter being flowed through the second catalyst bed of the selected chamber. Since the first catalyst bed comprises a catalyst material having a low catalytic activity and a high porosity and less feed gas mixture is flowed through such a catalyst bed, the temperature of reaction in the first catalyst bed of each chamber can be easily controlled so that there is no formation of hot spots. On the other hand, since the minor portion comprising cool feed gas mixture is mixed with partially reacted gases leaving the first catalyst bed prior to contacting the second catalyst bed, the temperature of reaction in the second catalyst bed of each chamber can also be easily controlled so that there is no formation of hot spots. The use in the second catalyst bed of a catalyst material having a high catalytic activity and a porosity lower than that of the catalyst material of the first catalyst bed ensures a complete reaction.

A variety of feed gas mixtures can be reacted in accordance with the invention. For example, the feed gas mixture may be a mixture of sulfur dioxide and oxygen for the production of sulfur trioxide, a mixture of hydrogen sulfide and sulfur dioxide for the production of sulfur, a mixture of ammonia and $NO_x$ for the reduction of nitrous oxides, a mixture of methane and water vapor for the production of carbon monoxide and hydrogen or any other suitable gaseous mixture which can be reacted in the presence of a catalyst.

Since the process according to the invention is carried out under controlled low temperature condition, not only is there no formation of hot spots in the catalyst beds, but there is also no generation of $NO_x$. Due to the low temperature regime, the life of the catalyst is increased. When carrying out the combustion of methane, the hot gases produced can be used for direct drying of food and/or other energy receivers.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1A:
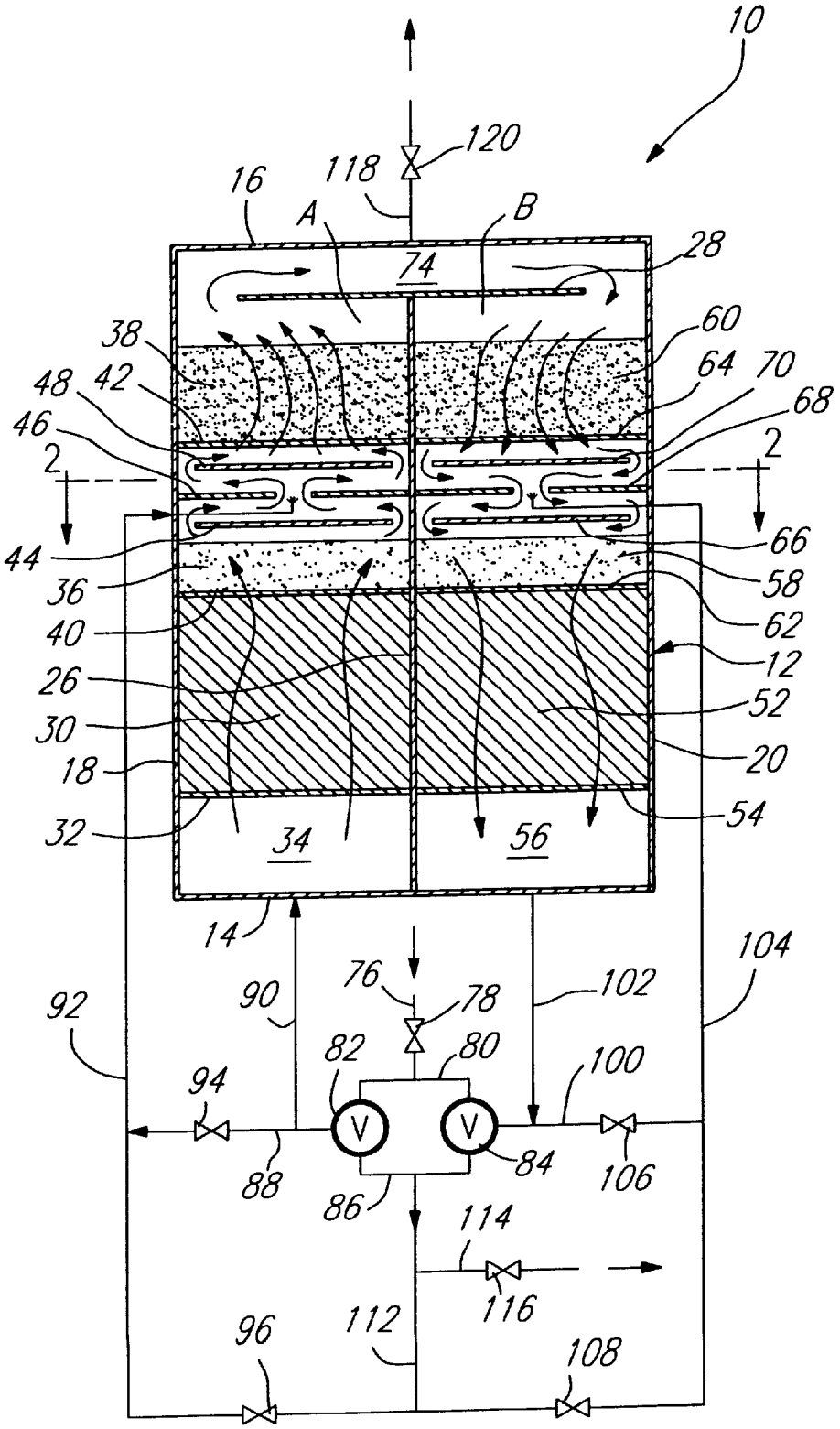
FIGS. 1A and 1B are schematic sectional views showing an apparatus for the catalytic combustion of combustible gases, according to a first preferred embodiment of the invention.
Figure 1B:
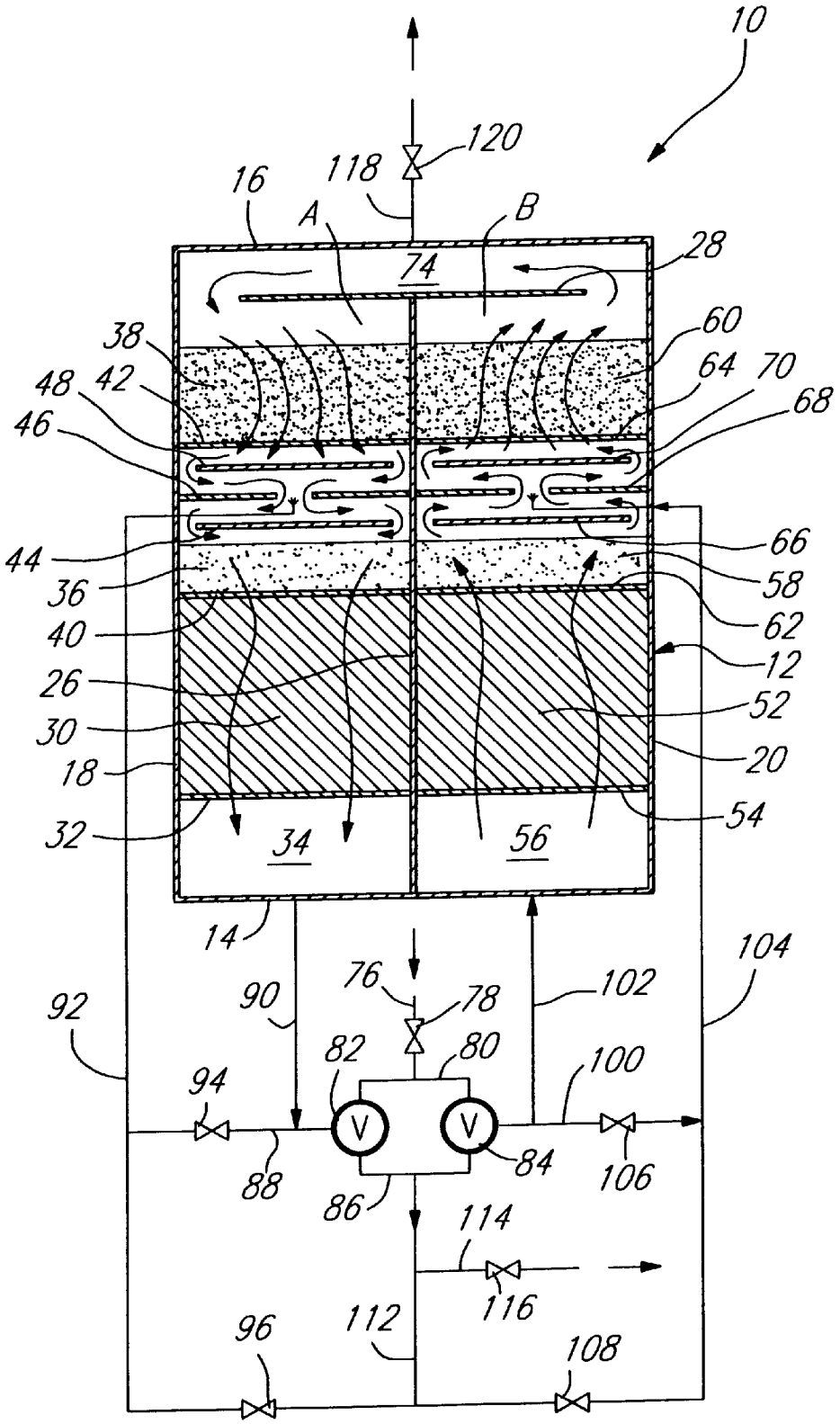
Figure 2:
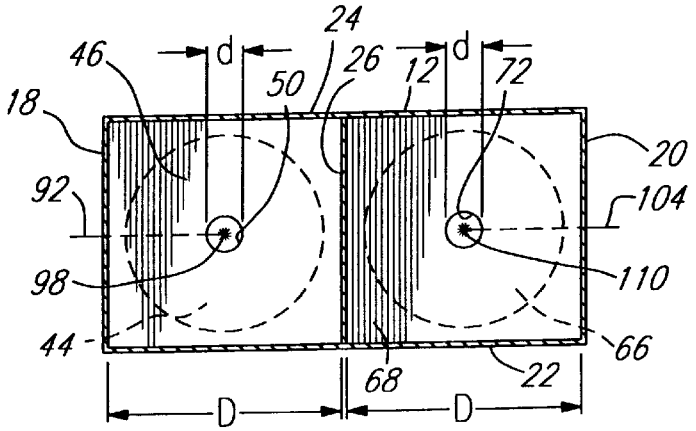
FIG. 2 is a sectional view taken along line 2—2 of FIG. 1A.

Referring first to FIGS. 1A and 1B, there is illustrated an apparatus 10 for the catalytic combustion of a combustible feed gas mixture such as a mixture of natural gas and air. The apparatus 10 comprises an elongated housing 12 of rectangular section having a bottom wall 14, a top wall 16 and two pairs of opposed sidewalls 18,20 and 22,24, the sidewalls 22 and 24 being shown in FIG. 2. A central partition 26 extends vertically inside the housing 12 to define two chambers A and B. The partition 26 is provided with a planar baffle element 28 which extends transversely thereof across the chambers A and B. Chamber A contains a bed 30 of heat exchange material supported on a grid member 32 above a gas distribution/collection compartment 34. The chamber A further contains two vertically spaced-apart beds 36,38 of catalyst material supported on grid members 40 and 42, respectively. A baffle arrangement comprising three vertically spaced-apart planar baffle elements 44, 46 and 48 is disposed between the catalyst beds 36 and 38, the baffle element 46 being provided with a central aperture 50 of circular outline, as best shown in FIG. 2. The baffle elements 44 and 48 are circular and mounted on the baffle element 46 by means of leg members (not shown). Similarly, chamber B contains a bed 52 of heat exchange material supported on a grid member 54 above a gas distribution/collection compartment 56. The chamber B also contains two vertically spaced-apart beds 58,60 of catalyst material supported on grid members 62 and 64, respectively. A baffle arrangement comprising three vertically spaced-apart planar baffle elements 66, 68 and 70 is disposed between the catalyst beds 58 and 60, the baffle element 68 being provided with a central aperture 72 of circular outline, as best shown in FIG. 2. The baffle elements 66 and 70 are circular and mounted on the baffle element 68 by means of leg members (not shown). The baffle element 28 is spaced from the top wall 16 to define therebetween a compartment 74 which is in fluid communication with chambers A and B.

The beds 30,52 of heat exchange material act as regenerative heat exchangers. Examples of suitable heat exchange materials which may be used include silica and alumina. The catalyst beds 36,58 comprise a porous catalyst material of monolithic form having a low catalytic activity and providing a conversion of no more than about 65%. Such a catalyst material has a porosity ranging from about 0.6 to about 0.85 so as to provide a small pressure resistance, thereby permitting a high gas flow. For example, use can be made of manganese oxide supported on alumina. The catalyst beds 38,60, on the other hand, comprise a porous catalyst material having a high catalytic activity and providing a conversion of about 100%. Such a catalyst material has a porosity ranging from about 0.4 to about 0.6. For example, use can be made of palladium supported on alumina in the form of rings.

The apparatus 10 further includes an inlet conduit 76 which is provided with valve 78 and is in fluid communication with a gas flow directing arrangement comprising an intake manifold 80, two three-way valves 82,84 and an exhaust manifold 86. Associated with chamber A are conduits 88, 90 an 92, the conduits 88 and 92 being provided with valves 94 and 96, respectively. The conduit 92 extends through the sidewall 18 and into the chamber A so as to open centrally in the aperture 50 of baffle element 46. As shown in FIG. 2, the conduit 92 is provided at the end thereof with an injector head 98. Associated with chamber B are conduits 100, 102 and 104, the conduits 100 and 104 being provided with valves 106 and 108, respectively. The conduit 104 extends through the sidewall 20 and into the chamber B so as to open centrally in the aperture 72 of baffle element 68. As shown in FIG. 2, the conduit 104 is provided at the end thereof with an injector head 110. The exhaust manifold 86 is connected to a conduit 112 which in turn is connected to conduits 92,104 and to an outlet conduit 114 provided with valve 116. A further outlet conduit 118 provided valve 120 is in fluid communication with compartment 74.

Chambers A and B are each selectively operable in a cooling mode and a heating mode. FIG. 1A illustrates the direction of gas flow when chamber A is in the cooling mode and chamber B is in the heating mode. FIG. 1B illustrates the direction of gas flow when chamber A is in the heating mode and chamber B is in the cooling mode. The process which is carried out in the apparatus 10 employs a four-phase (phase I through IV) described below. In all four phases, valve 78 remains opened.

Phase I (FIG. 1A)

Initially, valves 94, 116 and 120 are opened and valves 96, 106 and 108 are closed. The three-ways valves 82 and 84 are positioned so that the intake manifold 80 is in fluid communication with conduit 88 and the exhaust manifold 86 is in fluid communication with conduit 100. A feed gas mixture containing natural gas and air typically at a temperature of about 20° C. flows through the inlet conduit 76, intake manifold 80 and conduit 88 and is distributed between conduits 90 and 92. Valve 94 is operated so that the portion of gases flowing through conduit 90 represents about 75 to about 95 vol. % of the feed gas mixture and the portion of gases flowing through conduit 92 represents about 5 to about 25 vol. % of the feed gas mixture. The portion of gases which is conducted through conduit 90 enters chamber A and flows through the gas distribution/collection compartment 34 and the bed 30 of heat exchange material. In the bed 30, the heat exchange material which has been heated by an external source of heat (not shown) preheats the gas mixture to about 350–500° C. at which the combustion starts. The natural gas is combusted in the catalyst bed 36 where about 65% of the methane content of the gas portion flowing through conduit 90 is converted to carbon dioxide and water vapor. A large amount of heat is released in the catalyst bed 36, causing its temperature to rise to about 600–750° C.

The gases after partial combustion with a temperature of about 600–750° C. are deflected by the baffle arrangement 44,46,48 so that the gas flow is directed around the baffle element 44, through the aperture 50 of the baffle element 46 and around the baffle element 48, the combustion products being mixed with cool unreacted gas mixture conducted via conduit 92 and injected through the aperture 50 of baffle element 46. The temperature of the gases after mixing drops to about 500–600° C. With this temperature the gas mixture enters the second catalyst bed 38 for the next stage of combustion. In the catalyst bed 38, the conversion of methane is about 99.5–100%. After the second combustion, the temperature of the gases increases to about 600–700° C. The gases leaving the catalyst bed 38 flow around the baffle element 28 and through compartment 74. About 30–90 vol. % of the hot combustion products is discharged from the compartment 74 through conduit 118. The remaining portion of the gases flows around the baffle element 28 and enters chamber B. In the chamber B, the remaining gas portion flows through the catalyst bed 60, is deflected by the baffle arrangement 66,68,70, flows through the catalyst bed 58, the heat exchange bed 52, the distribution/collection compartment 56 and through conduits 102,100, exhaust manifold 86 and conduit 112 and is discharged through conduit 114. Under these conditions, a creeping temperature front is created. The hot front starts moving along the following path: beds 30-36-38-60-58-52.

After a time period of about 2 to 60 minutes, the heat exchange bed 30 becomes cool and the heat exchange bed 52 becomes hot. A periodic change of the direction of gas flow through the catalyst beds and heat exchange beds prevents the heat from leaving the reactor. Reversing the direction of gas flow by switching valves 82 and 84 initiates phase II.

Phase II

At the end of phase I, valves 94 and 116 are closed and valve 96 is opened. The combustion products are by-passed through conduit 92 to enter chamber A. At that time, reversal of the direction of gas flow by switching the three-way valves 82 and 84 begins. Valve 82 is positioned so that the exhaust manifold 86 is in fluid communication with conduit 88 and valve 84 is positioned so that the intake manifold 80 is in fluid communication with conduit 100. Valve 106 is then opened. The gas flow is thus directed to chamber B. The duration of phase II is about 10 to 60 seconds. Valve 96 is thereafter closed and valve 116 is opened to initiate phase III.

Phase III (FIG. 1B)

Since the three-way valve 84 is positioned so that the intake manifold 80 is in fluid communication with conduit 100, the feed gas mixture flowing through inlet conduit 76, intake manifold 80 and conduit 100 is distributed between conduits 102 and 104. Valve 106 is operated so that the portion of gases flowing through conduit 102 represents about 75 to about 95 vol. % of the feed gas mixture and the portion of gases flowing through conduit 104 represents about 5 to about 25 vol. % of the feed gas mixture. The portion of gases which is conducted through conduit 102 enters chamber B and flows through the gas distribution/collection compartment 56 and the bed 52 of heat exchange material. In the bed 52, the heat exchange material which has been heated during phase I preheats the gas mixture to about 350–500° C. at which the combustion starts. The natural gas is combusted in the catalyst bed 58 where about 65% of the methane content of the gas portion flowing through conduit 102 is converted to carbon dioxide and water vapor. The heat released in the catalyst bed 58 causes the temperature to rise to about 600–750° C.

The gases after partial combustion with a temperature of about 600–750° C. are deflected by the baffle arrangement 66,68,70 so that the gas flow is directed around the baffle element 66 through the aperture 72 of the baffle element 68 and around the baffle element 70, the combustion products being mixed with cool unreacted gas mixture conducted via conduit 104 and injected through the aperture 72 of baffle element 68. The temperature of the gases after mixing drops to about 500–600° C. With this temperature the gas mixture enters the second catalyst bed 60 for the next stage of combustion. In the catalyst bed 60, the conversion of methane is about 99.5–100%. After the second combustion, the temperature of the gases increases to about 600–700° C. The gases leaving the catalyst bed 60 flow around the baffle element 28 and through compartment 74. About 30–90 vol. % of the hot combustion products is discharged from the compartment 74 through conduit 118. The remaining portion of the gases flows around the baffle element 28 and enters chamber A. In the chamber A, the remaining gas portion flows through the catalyst bed 38, is deflected by the baffle arrangement 44,46,48, flows through the catalyst bed 36, the heat exchange bed 30, the distribution/collection compartment 34 and through conduits 90 and 88, exhaust manifold 86 and conduit 112 and is discharged through conduit 114. Under these conditions, a creeping temperature front is created. The hot front starts moving along the following path: beds 52-58-60-38-36-30.

After a time period of about 2 to 60 minutes, the heat exchange bed 52 becomes cool and the heat exchange bed 30 becomes hot. At that time, the gas flow direction is reversed by switching valves 82 and 84 to initiate phase IV.

Phase IV

At the end of phase III, valves 106 and 116 are closed and valve 108 is opened. The combustion products are by-passed through conduit 104 to enter chamber B. At that time, reversal of the direction of gas flow by switching the three-way valves 82 and 84 begins. Valve 82 is positioned so that the intake manifold 80 is in fluid communication with conduit 88 and valve 84 is positioned so that the exhaust manifold 82 is in fluid communication with conduit 100. Valve 94 is then opened. The gas flow is thus directed to chamber A. After a duration of about 10 to 60 seconds. Valve 108 is closed and valve 116 is opened to initiate phase I.

The position of valves 82, 84, 94, 96, 106, 108, 116 and 120 in each of the four phases described above and typical phase times are summarized in the following Table:

| | Valve No. | | | | | | | | |
|---|---|---|---|---|---|---|---|---|---|
| Phase | 82 | 84 | 94 | 96 | 106 | 108 | 116 | 120 | Time |
| I | 80/88 | 86/100 | O | C | C | C | O | O | 2–60 min. |
| II | 86/88 | 80/100 | O | O | C | C | C | O | 10–60 sec. |
| III | 86/88 | 80/100 | C | C | O | C | O | O | 2–60 min. |
| IV | 80/88 | 86/100 | C | C | O | O | C | O | 10–60 sec. |

O: open; C: closed.

After several switchings, usually 5 to 10, a stable temperature regime occurs in the apparatus 10 with a hot zone being formed between chambers A and B and located in compartment 74.

The formation of hot spots in the catalyst beds 36,38 and 58,60 during phases I and II is prevented by controlling the temperature of reaction in the catalyst beds below a predetermined maximum temperature. Such the maximum temperature depends on the type of exothermic reaction involved as well as on the type of catalyst material utilized. For example, when carrying out the combustion of natural gas and using manganese oxide supported on alumina and palladium supported on alumina as catalyst materials in the beds 36,62 and 38,60, respectively, such a maximum temperature is about 750° C. Temperature control is achieved by discharging a portion of hot combusted gas from the hot zone defined in compartment 74 so as to withdraw sufficient heat to maintain the temperature of reaction in the catalyst beds below about 750° C., while maintaining autothermicity of the process. When the concentration of methane in the feed gas mixture is less than 1 vol. %, such a heat withdrawal is sufficient to maintain the temperature of reaction below 750° C.; in this case, valves 94 and 106 can be closed during phases I and III of the process. However, when the concentration of methane in the feed gas mixture is greater than 1 vol. %, it is necessary to also distribute the feed gas mixture between conduits 90 and 92 when chamber A is in the cooling mode and between conduits 102 and 104 when chamber B is in the cooling mode. Since less combustible gas conducted via conduit 90 or 102 flows through the catalyst bed 36 or 62 and use is made in these beds of a catalyst material having a low catalytic activity and a high porosity, the temperature of reaction in the catalyst beds 36,62 can be easily controlled so that there is no formation of hot spots. On the other hand, since cool feed gas mixture conducted via conduit 92 or 104 is mixed with partially combusted gases leaving the catalyst bed 36 or 58 prior to contacting the catalyst bed 38 or 60, the temperature of reaction in the catalyst beds 38,60 can also be easily controlled so that there is no formation of hot spots. Good mixing and low pressure drop are achieved by selecting a diameter for the circular apertures 50,72 of baffle elements 46,68 which is related to the width of chambers A,B as follows:

$$0.18 \leq \frac{d}{D} \leq 0.26$$

where d is the diameter of apertures 46,48, and

D is the width of chambers A,B, as shown in FIG. 2. The use in beds 38,60 of a catalyst material having a high catalytic activity and a porosity lower than that of the catalyst material of beds 36,58 ensures a complete reaction.

Figure 3:
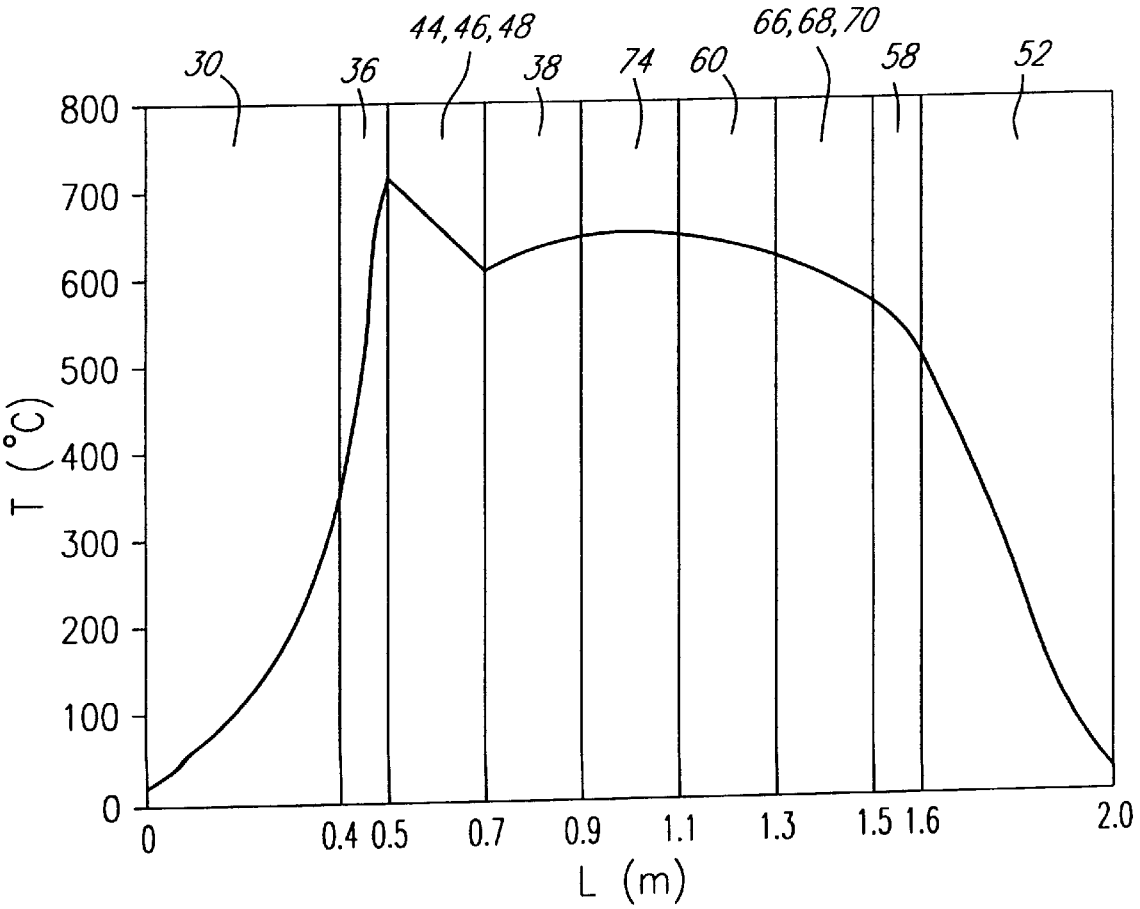
FIG. 3 is a diagram illustrating the temperature profile in the apparatus of FIG. 1A.

FIG. 3 illustrates the temperature profile in the apparatus 10 during phase I after a stable temperature has been reached and just before reversing the direction of gas flow. The various sections of the apparatus through which the gases flow have been indicated for clarity purpose. As shown, the hot zone where maximum temperature is attained is located in the compartment 74. Thus, by discharging a portion of the combustion products from the hot zone, sufficient heat can be withdrawn to maintain the temperature of reaction below 750° C., thereby preventing the formation of hot spots in the catalyst beds. For example, when the concentration of methane in the feed gas mixture is about 1 vol. %, about 30 vol. % of the combustion products is discharged from the hot zone. When the methane concentration is about 2–3 vol. %, the portion of combustion products discharged from the hot zone is increased to about 70–90 vol. %.

Figure 4:
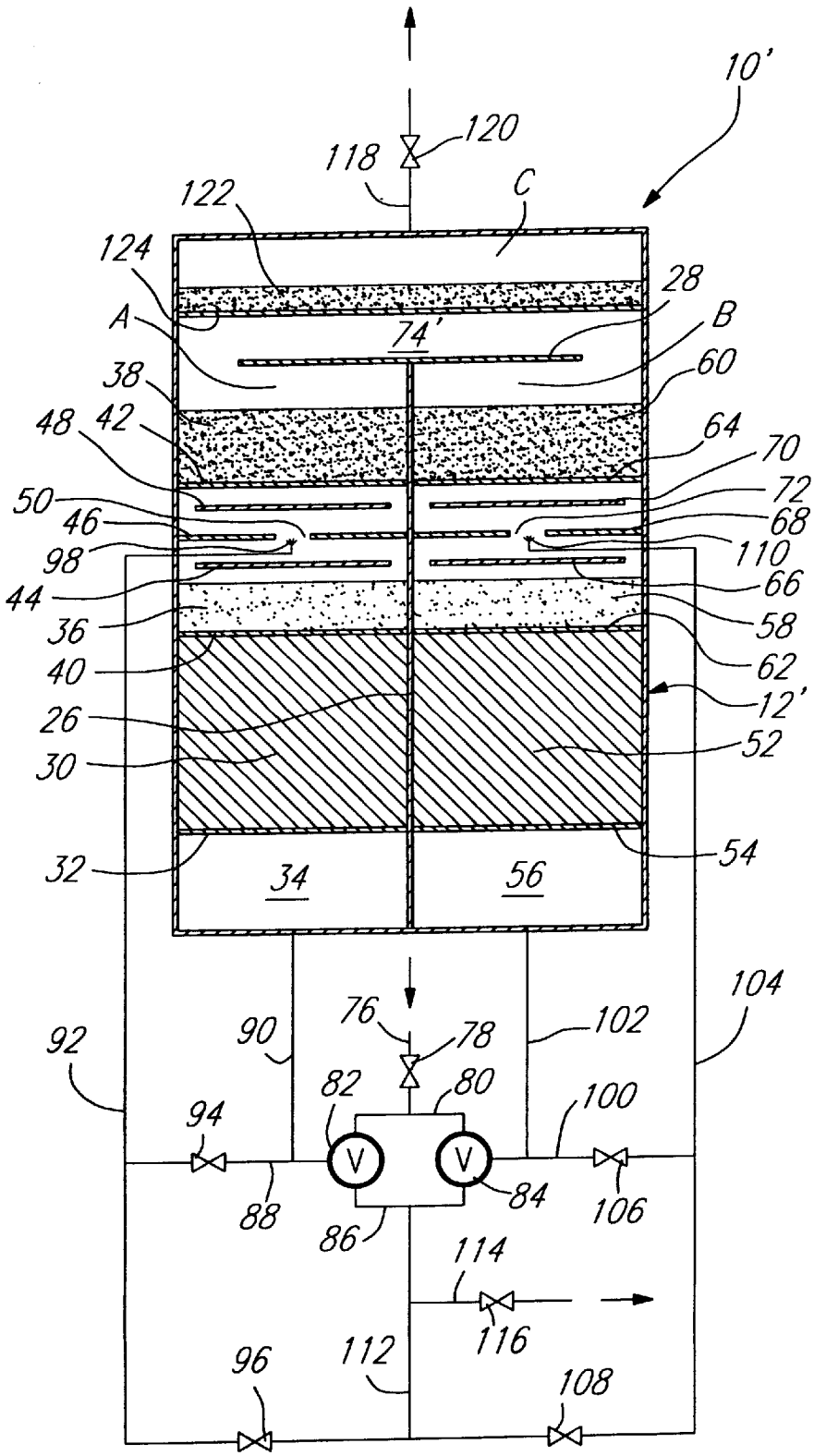
FIG. 4 is a schematic sectional view of another apparatus according to a second preferred embodiment of the invention.

FIG. 4 illustrates an apparatus 10' which is similar to the apparatus 10 shown in FIGS. 1A and 1B, with the exception that the height of housing 12' has been increased to define a third chamber C above the compartment 74' and in fluid communication therewith. As shown in FIG. 4, chamber C contains a bed 122 of catalyst material supported on a grid member 124, the catalyst material of bed 122 having a high catalytic activity. The provision of such a catalyst bed 122 ensures that any remaining unreacted gases in the compartment 74' are combusted in the catalyst bed 122 prior to being discharged through conduit 118.

Figure 5:
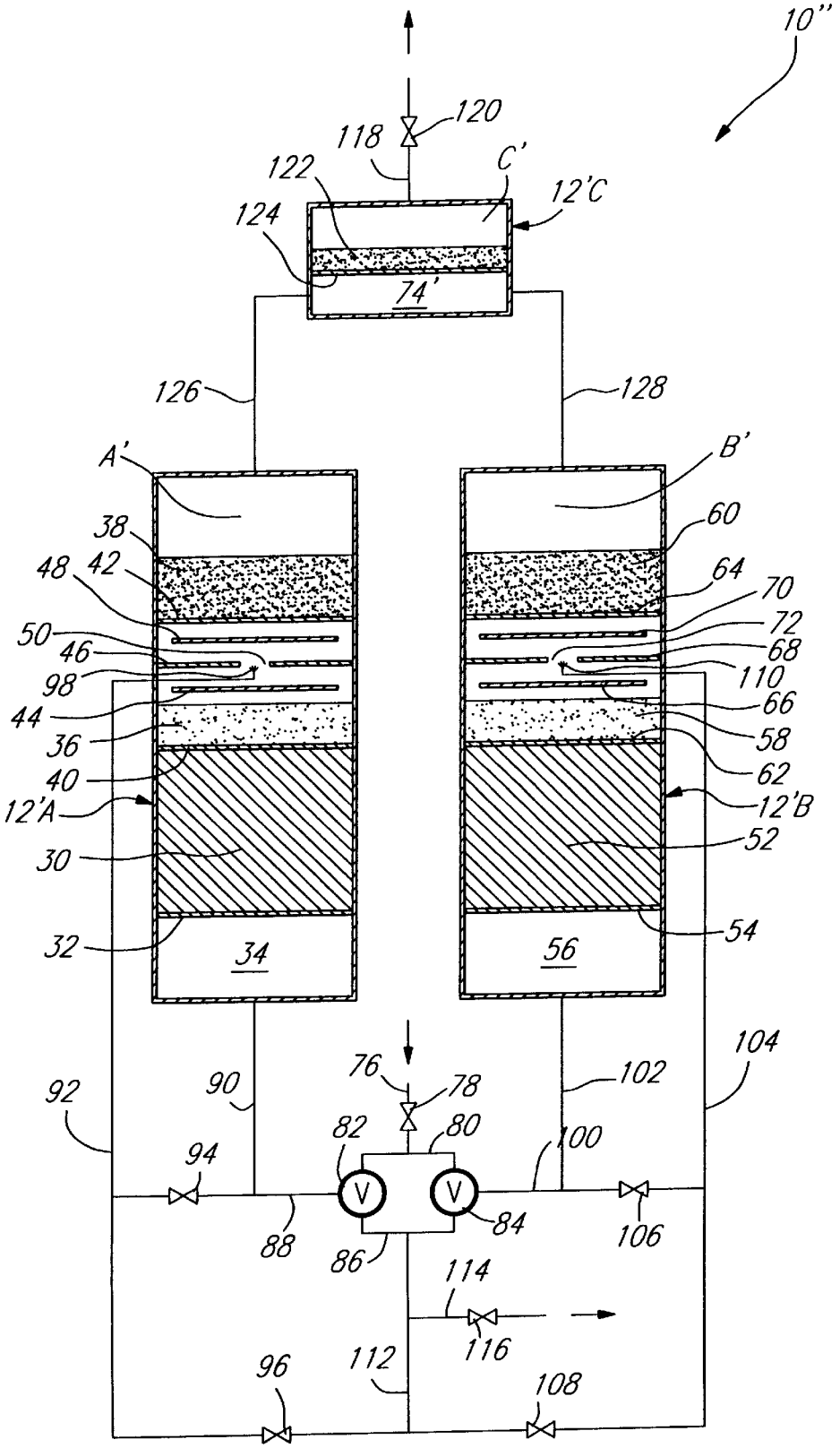
FIG. 5 is a schematic sectional view of a further apparatus according to a third preferred embodiment of the invention.

FIG. 5 illustrates an apparatus 10" which is similar to the apparatus 10' shown in FIG. 4, with the exception that the chambers A', B' and C' have separate housings 12'A, 12'B and 12'C, respectively. As shown in FIG. 5, conduits 126 and 128 interconnect the chamber C' with chambers A' and B'. The apparatus 10" is particularly useful for the catalytic combustion of large volumes of combustible gases.

We claim:

1. A process for the gas phase exothermic reaction of a feed gas mixture, comprising:

a) providing first and second chambers in fluid communication with one another and each containing a bed of solid heat exchange material and first and second beds of catalyst material with the second catalyst bed being disposed in spaced relation to the first catalyst bed and downstream thereof when said chambers are in a cooling mode, said first catalyst bed comprising a catalyst material having a low catalytic activity and said second catalyst bed comprising a catalyst material having a high catalytic activity, each said chamber being selectively operable in cooling and heating modes;

b) introducing the feed gas mixture into a selected one of said first and second chambers when a selected chamber is in said cooling mode and the other of said first and second chambers is in said heating mode;

c) dividing said feed gas mixture into major and minor portions, causing the major portion to flow through said bed of heat exchange material and said first catalyst bed of said selected chamber, mixing the minor portion with the gaseous product formed in said first catalyst bed and thereafter causing the resulting gas mixture to flow through said second catalyst bed of said selected chamber, the feed gas mixture being reacted in said first and second catalyst beds to form a gaseous product;

d) conducting the gaseous product from said selected chamber to the other of said first and second chambers;

e) causing the gaseous product to flow through said other chamber so that said gaseous product contacts the beds of catalyst material before contacting the bed of heat exchange material;

f) periodically reversing the direction of gas flow through said chambers so that said first chamber and said second chamber alternately operate in said cooling and heating modes, thereby forming between said first and second chambers a hot zone containing said gaseous product; and g) discharging a portion of said gaseous product from said hot zone so as to withdraw sufficient heat to maintain the reaction in the catalyst beds of said selected chamber at a temperature below a predetermined maximum temperature, while maintaining autothermicity.

2. A process as claimed in claim 1, wherein said catalyst material of low catalytic activity provides a conversion of no more than about 65% and wherein said catalyst material of high catalytic activity provides a conversion of about 100%.

3. A process as claimed in claim 2, wherein said catalyst material of low catalytic activity is a porous catalyst material of monolithic form having a porosity ranging from about 0.6 to about 0.85.

4. A process as claimed in claim 2, wherein said catalyst material of high catalytic activity is a porous catalyst material having a porosity of about 0.4 to about 0.6.

5. A process as claimed in claim 2, wherein said feed gas mixture comprises methane and oxygen and said predetermined maximum temperature is about 750° C.

6. A process as claimed in claim 5, wherein the portion of gaseous product discharged from said hot zone represents about 30 to about 90 vol. %.

7. A process as claimed in claim 1, wherein said catalyst material of low catalytic activity is a porous catalyst material of monolithic form having a porosity ranging from about 0.6 to about 0.85.

8. A process as claimed in claim 1, wherein said catalyst material of high catalytic activity is a porous catalyst material having a porosity of about 0.4 to about 0.6.

9. A process as claimed in claim 1, wherein said major portion comprises about 75 to about 95 vol. % of said feed gas mixture and said minor portion comprises about 5 to about 25 vol. % of said feed gas mixture.

10. A process as claimed in claim 1, wherein a third chamber containing a bed of catalyst material is provided in fluid communication with said hot zone, said portion of gaseous product flowing through the catalyst bed of said third chamber prior to being discharged therefrom.

11. A process as claimed in claim 10, wherein the catalyst bed of said third chamber comprises a catalyst material of high catalytic activity.

12. An apparatus for the gas phase exothermic reaction of a feed gas mixture, comprising:

at least one housing defining first and second chambers in fluid communication with one another and each containing a bed of solid heat exchange material and first and second beds of catalyst material with the second catalyst bed being disposed in spaced relation to the first catalyst bed and downstream thereof when said chambers are in a cooling mode, said first catalyst bed comprising a catalyst material having a low catalytic activity and said second catalyst bed comprising a catalyst material having a high catalytic activity, each said chamber being selectively operable in cooling and heating modes;

inlet means for introducing the feed gas mixture into a selected one of said first and second chambers when said selected chamber is in said cooling mode and the other of said first and second chambers is in said heating mode so that the feed gas mixture flowing through said selected chamber contacts the bed of heat exchange material before contacting the bed of catalyst material, said inlet means comprising first and second conduits with valve means for dividing said feed gas mixture into major and minor portions so that the major portion is conducted via said first conduit to flow through said bed of heat exchange material and said first catalyst bed of said selected chamber and the minor portion is conducted via said second conduit to flow through said second catalyst bed of said selected chamber, mixing means being arranged between said first and second catalyst beds for mixing gaseous product formed in said first catalyst bed with said minor portion of feed gas mixture prior to contacting said second catalyst bed, the feed gas mixture being reacted in said first and second catalyst beds to form a gaseous product;

means for conducting the gaseous product from said selected chamber to said other chamber so that the gaseous product flowing through said other chamber contacts the beds of catalyst material before contacting the bed of heat exchange material;

gas flow directing means for periodically reversing the direction of gas flow through said chambers so that said first chamber and second chamber alternately operate in said cooling and heating modes, thereby forming between said first and second chambers a hot zone containing said gaseous product; and outlet means in fluid communication with said hot zone for discharging a portion of the gaseous product from said hot zone so as to withdraw sufficient heat to maintain the reaction in the catalyst beds of said selected chamber at a temperature below a predetermined maximum temperature, while maintaining autothermicity.

13. An apparatus as claimed in claim 12, wherein said catalyst material of low catalytic activity provides a conversion of no more than about 65% and wherein said catalyst material of high catalytic activity provides a conversion of about 100%.

14. An apparatus as claimed in claim 13, wherein said catalyst material of low catalytic activity is a porous catalyst material of monolithic form having a porosity ranging from about 0.6 to about 0.85.

15. An apparatus as claimed in claim 13, wherein said catalyst material of high catalytic activity is a porous catalyst material having a porosity of about 0.4 to about 0.6.

16. An apparatus as claimed in claim 12, wherein said catalyst material of low catalytic activity is a porous catalyst material of monolithic form having a porosity ranging from about 0.6 to about 0.85.

17. An apparatus as claimed in claim 12, wherein said catalyst material of high catalytic activity is a porous catalyst material having a porosity of about 0.4 to about 0.6.

18. An apparatus as claimed in claim 12, wherein said mixing means comprise baffle means.

19. An apparatus as claimed in claim 18, wherein said baffle means comprise first, second and third planar baffle elements disposed in spaced-apart parallel relationship with one another with said second baffle element having a central aperture defined therethrough, said first, second and third baffle elements being arranged relative to one another across each said chamber so that gas flow is directed around said first baffle element, through said aperture of said second baffle element and around said third baffle element, and wherein said second conduit extends into each said chamber to open substantially centrally in said aperture of said second baffle element.

20. An apparatus as claimed in claim 19, wherein said first and second chambers are elongated and each have a predetermined transverse dimension and wherein said aperture of said second plate member has a circular outline with a predetermined diameter which is related to said transverse dimension as follows:

$$0.18 \leq \frac{d}{D} \leq 0.26$$

where d is the diameter of said aperture, and

D is the transverse dimension of each said chamber.

21. An apparatus as claimed in claim 12, including further outlet means for discharging a remaining portion of said gaseous product from said other chamber after said remaining portion has flowed through the first and second beds of catalyst material and the bed of heat exchange material of said other chamber.

22. An apparatus as claimed in claim 12, including a third chamber in fluid communication with said hot zone, said third chamber containing a bed of catalyst material disposed so that said portion of gaseous product flows through the catalyst bed of said third chamber prior to being discharged therefrom.

23. An apparatus as claimed in claim 12, wherein said at least one housing comprises a single elongated housing having a substantially central longitudinally extending partition defining on either side thereof said first and second chambers, and wherein said means for conducting said gaseous product from said selected chamber to said other chamber comprises a planar baffle element extending transversely of said partition and across said first and second chambers, said baffle element being spaced from an end wall of said housing to define therebetween a compartment in fluid communication with said first and second chambers and comprising said hot zone.

24. An apparatus as claimed in claim 22, wherein said at least one housing comprises a single elongated housing having a substantially central longitudinally extending partition defining on either side thereof said first and second chambers, and wherein said means for conducting said gaseous product from said selected chamber to said other chamber comprises a planar baffle element extending transversely of said partition and across said first and second chambers, said baffle element being spaced from an end wall of said housing to define therebetween said third chamber, the catalyst bed of said third chamber being spaced from said baffle element to define therebetween a compartment in fluid communication with said first and second chambers and comprising said hot zone.

25. An apparatus as claimed in claim 22, wherein said at least one housing comprises first, second and third housings defining said first, second and third chambers respectively, and wherein said means for conducting said gaseous product from said selected chamber to said other chamber comprise conduit means interconnecting said third chamber with said first and second chambers.

* * * * *